US007234948B2

(12) United States Patent
Kim et al.

(10) Patent No.: US 7,234,948 B2
(45) Date of Patent: Jun. 26, 2007

(54) DIRECTIONAL COUPLER INTEGRATED WITH CONNECTORS

(75) Inventors: Duk-Yong Kim, Hwaseong-si (KR); Jong-Kyu Park, Osan-si (KR); Su-Hee Lee, Yongin-si (KR); Sun-Woong Park, Yongin-si (KR)

(73) Assignee: KMW Inc, Hwaseong-si, Gye (KR)

( * ) Notice: Subject to any disclaimer, the term of this patent is extended or adjusted under 35 U.S.C. 154(b) by 0 days.

(21) Appl. No.: 10/734,789

(22) Filed: Dec. 12, 2003

(65) Prior Publication Data

US 2004/0127103 A1 Jul. 1, 2004

(30) Foreign Application Priority Data

Dec. 14, 2002 (KR) ..... 10-2002-0080030

(51) Int. Cl.
*H01R 13/73* (2006.01)

(52) U.S. Cl. ..... 439/76.1

(58) Field of Classification Search ..... 439/76.1, 439/579; 174/541, 59; 333/109, 15, 111, 333/115

See application file for complete search history.

(56) References Cited

U.S. PATENT DOCUMENTS

| | | | | |
|---|---|---|---|---|
| 3,798,574 | A | 3/1974 | Workman | 333/10 |
| 3,989,333 | A * | 11/1976 | Cauldwell | 439/76.1 |
| 5,047,737 | A | 9/1991 | Oldfield | 333/22 |
| 5,382,932 | A | 1/1995 | Monti | 333/245 |
| 5,607,325 | A * | 3/1997 | Toma | 439/578 |
| 5,675,300 | A * | 10/1997 | Romerein | 333/100 |
| 5,763,830 | A * | 6/1998 | Hsueh | 174/60 |
| 5,926,076 | A | 7/1999 | Johnson et al. | 333/109 |
| 6,053,769 | A * | 4/2000 | Kubota et al. | 439/578 |
| 6,155,871 | A * | 12/2000 | Machado | 439/535 |
| 6,624,722 | B2 * | 9/2003 | Wang et al. | 333/116 |

FOREIGN PATENT DOCUMENTS

JP 2003-032013 1/2003

* cited by examiner

*Primary Examiner*—Alexander Gilman
(74) *Attorney, Agent, or Firm*—Cha & Reiter, L.L.C.

(57) ABSTRACT

A connectors-integrated directional coupler is provided. The directional coupler includes a housing having a body, an input connector integrally extended from one end of the body, and an output connector integrally extended from the other end of the body. A main line connects the input connector to the output connector for delivering a signal. A coupling line induces the signal from the main line.

15 Claims, 6 Drawing Sheets

DIRECTIONAL COUPLER INTEGRATED WITH CONNECTORS

CLAIM OF PRIORITY

This application claims priority under 35 U.S.C. § 119 to an application entitled "Directional Coupler Integrated with Connectors," filed in the Korean Intellectual Property Office on Dec. 14, 2002 and assigned Serial No. 2002-80030, the contents of which are incorporated herein by reference.

BACKGROUND OF THE INVENTION

1. Field of the Invention

The present invention generally relates to a directional coupler for monitoring a signal exchanged in a wireless communication system and, in particular, to a directional coupler having input and output connectors integrated therein.

2. Description of the Related Art

In general, a directional coupler is designed to be used in a base station to detect a signal induced into a coupling line installed in the vicinity of a main line and extracts a signal source for examination and control purposes in a wireless communication system.

FIG. 1 is a perspective view illustrating a conventional directional coupler 100, and FIG. 2 is a sectional view illustrating the directional coupler 100 taken along line A-A' illustrated in FIG. 1.

As shown in FIGS. 1 and 2, the directional coupler 100 comprises a rectangular housing 110, an input connector 120 connected to one end of the housing 110, an output connector 130 connected to the other end of the housing 110, a main line 151 connecting the input connector 120 to the output connector 130 for delivering a signal, a coupling line 153 installed in parallel with the main line 151, and coupling terminals 141 and 143 at both ends of the coupling line 153. One of the coupling terminals 141 and 143 is grounded through a terminating resistor (not shown).

The components of the directional coupler 100 are fixed to the housing 110 to firmly tighten the connections between the coupling line 153, the coupling terminals 141 and 143, and the terminating resistor. Each of the input and output connectors 120 and 130 is provided with a flange 121 or 131 by which it is engaged with the housing 110. The main line 15 and the coupling line 153 are spaced from each other by a distance determined according to a system-required coupling value.

In operation, the input connector 120 transfers the signal received therein to the output connector 130 via the main line 150, while a part of the signal is induced to the coupling line 153.

The above conventional directional coupler is assembled by combining a separate housing, input connector, and output connector. Therefore, the manufacturing process is complicated, lengthy, and costly. Moreover, although the input and output connectors are coaxial, the housing is not. As such, a discontinuation occurs in the process of transmitting a signal from the circular coaxial input connector to the circular coaxial output connector through the rectangular housing, thus yielding a poor impedance matching and deteriorated directivity.

SUMMARY OF THE INVENTION

Accordingly, an object of the present invention is to provide a directional coupler coaxially integrated with the input and output connectors, thereby improving productivity and directivity.

In one embodiment, a connectors-integrated directional coupler includes a housing having a body, an input connector integrally extended from one end of the body, and an output connector integrally extended from the other end of the body. A main line connects the input connector to the output connector for delivering a signal, and a coupling line induces the signal from the main line.

BRIEF DESCRIPTION OF THE DRAWINGS

The above features and advantages of the present invention will become more apparent from the following detailed description when taken in conjunction with the accompanying drawings in which.

DETAILED DESCRIPTION OF THE PREFERRED EMBODIMENT

Figure 1:
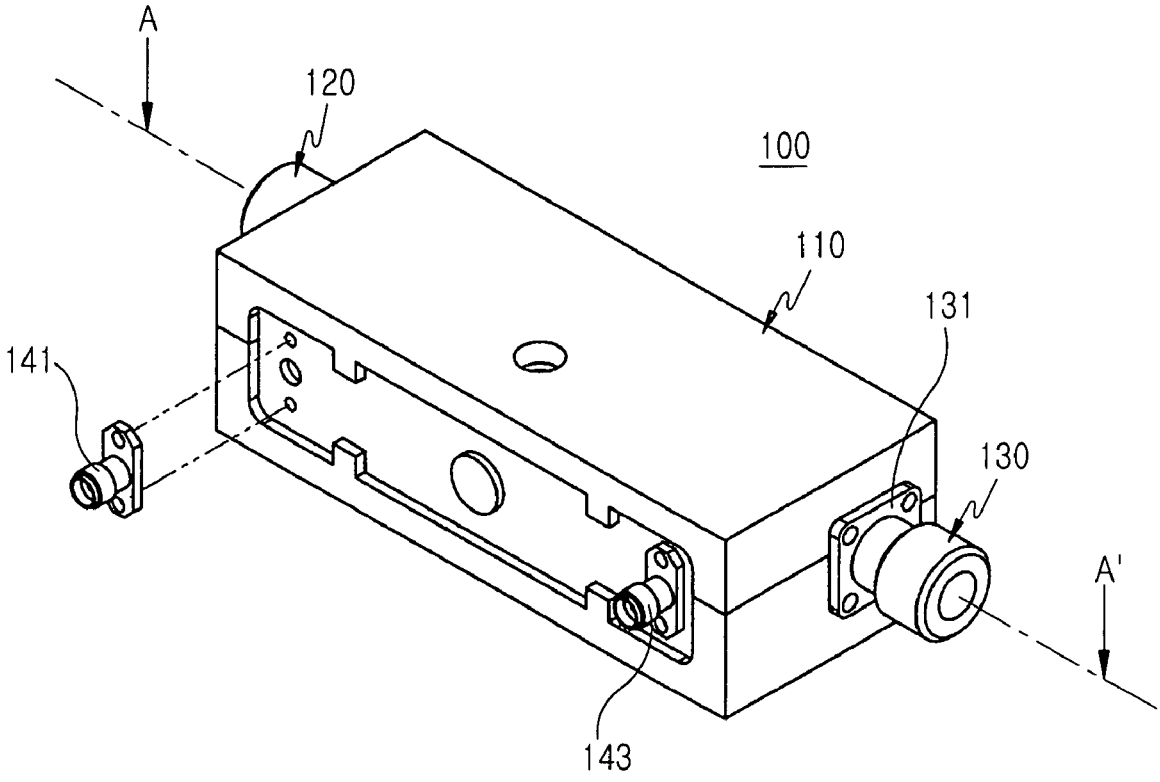
FIG. 1 PRIOR ART
FIG. 1 is a perspective view illustrating a conventional directional coupler.
Figure 2:
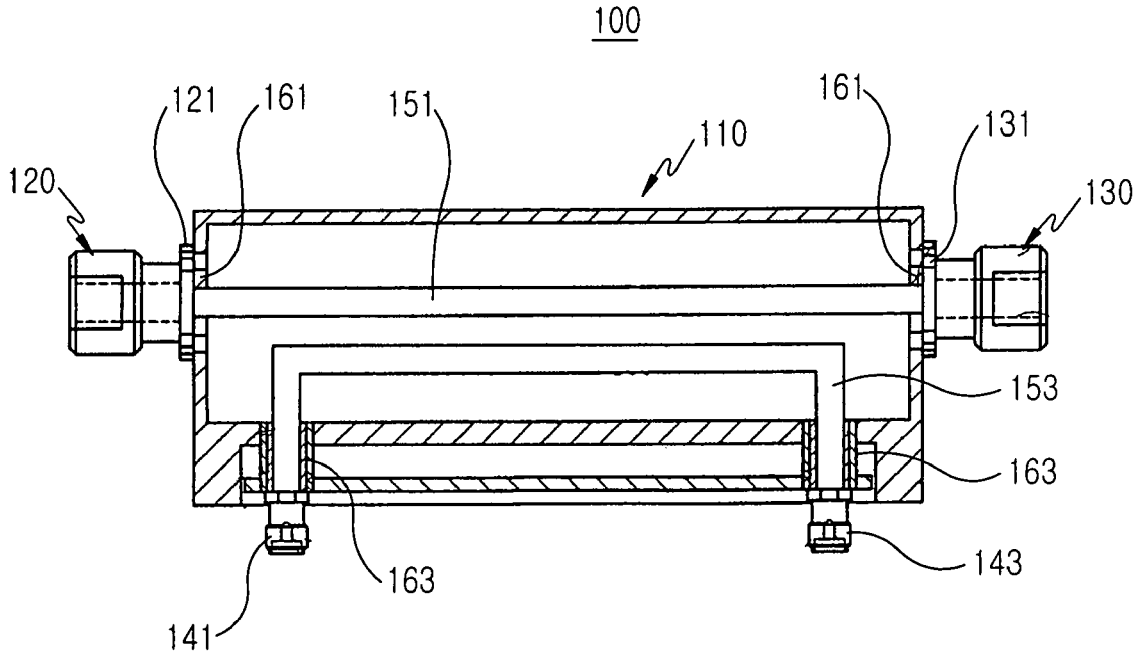
FIG.2 PRIOR ART
FIG. 2 is a sectional view illustrating the conventional directional coupler, taken along line A-A' illustrated in FIG. 1.
Figure 3:
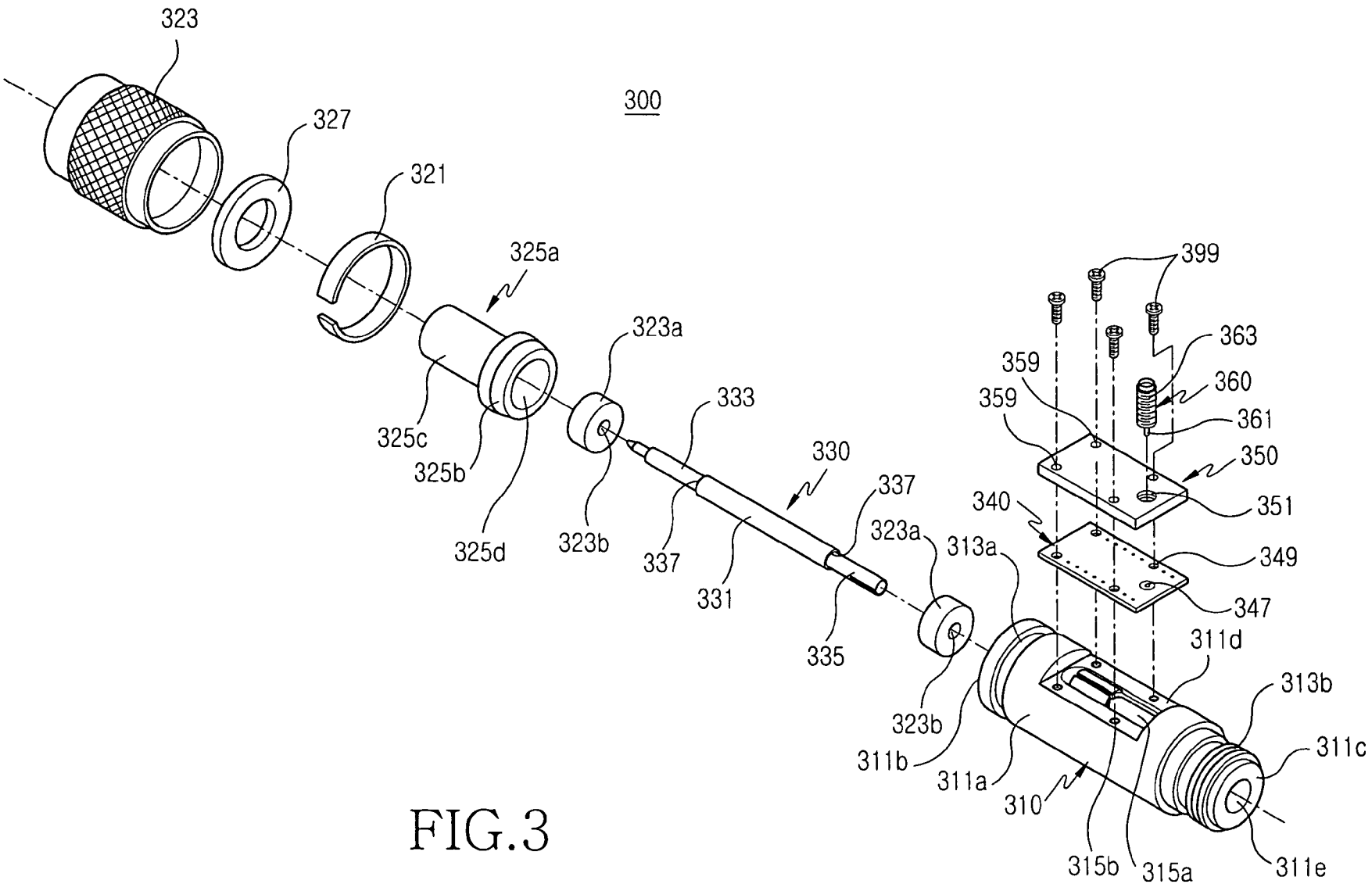
FIG. 3 is an exploded perspective view illustrating a directional coupler integrated with connectors according to a preferred embodiment of the present invention.

A preferred embodiment of the present invention will be described herein below with reference to the accompanying drawings. For the purposes of clarity and simplicity, well-known functions or constructions are not described in detail as they would obscure the invention in unnecessary detail.

Referring to FIGS. 3 to 6, the connectors-directional coupler 300 having connectors according to a preferred embodiment of the present invention includes a housing 310, a main line 330, and a coupling plate 340.

The housing 310 is provided with a body 311*a*, and first and second connectors 311*b* and 311*c* integrated at both ends of the body 311*a*. An elongated hole 311*e* is formed inside the housing 310, penetrating from the end of the first connector 311*b* to the end of the second connector 311*c* through the body 311*a*, thereby defining a space for accommodating the main line 330 therein. The first connector 311*b* functions as an output connector for the directional coupler 300, while the second connector 311*c* functions as an input connector for the directional coupler 300.

The body 311*a* is provided, at an outer circumferential surface thereof, with a planar mounting surface 311*d* having a predetermined width and length. An opening 315*a* is formed lengthwise along the mounting surface 311*d*. At least two coupling holes 315*b* are formed around the mounting surface 311*d*. In the case illustrated in FIG. 3, four coupling holes 315*b* are shown in the housing 310 for illustrative purposes, thus the number of holes should not limit the scope of the present invention.

The body 311*a* is provided, at an end thereof, with the first connector 311*b*, as stated above. A fixing groove 313*a* is formed to a predetermined depth on the outer circumferential surface of the end of the connector 311*b*. A fixing ring 321 is fixably fit around the fixing groove 313*a*, protruding to a predetermined height from the outer circumferential surface of the first connector 311*b*. The fixing ring 321 is cut out in a circumferential direction to create a gap of a predetermined length, so that it can be elastically transformed in a diameter direction. This facilitates the engagement of the fixing ring 321 around the fixing groove 313*a* elastically.

Figure 6:
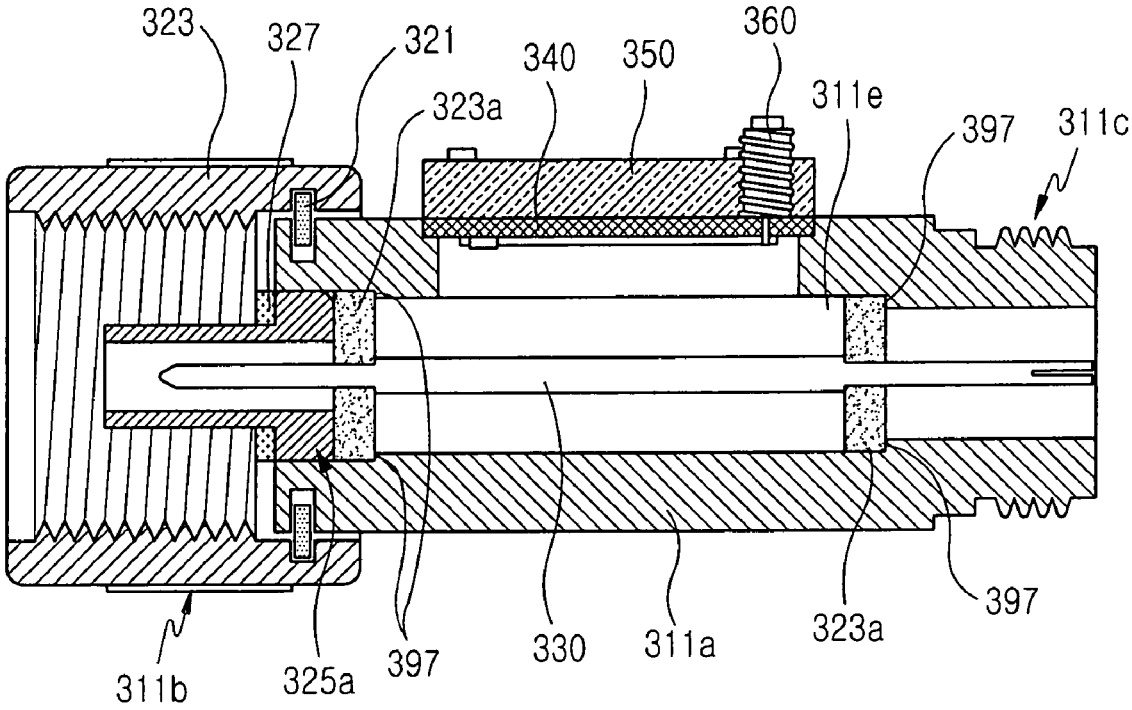
FIG. 6 is a sectional view illustrating the connectors-integrated directional coupler, taken along line B-B' illustrated in FIG. 5.

As illustrated in FIG. 6, the fixing ring 321 may be engaged around the fixing groove 313*a*, protruding to a predetermined height from the outer circumferential surface of the first connector 311*b*. The protruded fixing ring 321 serves as a coupling means for engaging the first connector 311*b* with a hollow cover 323. The hollow cover 323 is provided, at an end thereof, with a step around which the fixing ring 321 is fit and engaged with the first connector 311*b* so that it can be rotatable around the first connector 311*b*. Screw threads are formed on the inner circumferential surface of the hollow cover 323 along the circumference thereof, to allow the hollow cover 323 to be engaged with another part or an external signal line.

Meanwhile, the body 311*a* is provided, at the other end, with the second connector 311*c*. Screw threads 313*b* are formed on the outer circumferential surface of the second connector 311*c* for engagement with another part or an external signal line.

Note that the components of the directional coupler are traditionally fabricated separately and then assembled, the body 311*a*, the housing 310 according to the present invention is fabricated in one process since the first connector 311*b*, and the second connector 311*c* are integrally formed.

The main line 330 is inserted into the hole 311*e* of the housing 310, supported by two Teflon support members 323*a*. Each of the Teflon support members 323*a* is provided with a hole 323*b* adapted to allow the main line 330 to extend therethrough. As such, the Teflon support members 323*a* provide electrical isolation between the housing 310 and the main line 330. That is, the Teflon support members 323*a* (see FIG. 6) are formed in the through hole 311*e* of the housing 310 in order to fix the Teflon support members 323*a* in place. The main line 330 is also provided with steps 337 to fix the Teflon support members 323*a* in place.

The main line 330 comprises a central main bar 331, sub-bars 333 and 335 integrally extending from both ends of the main bar 331. The sub-bars 333 and 335 have a smaller diameter than that of the main bar 331.

The main line 330 is fixably inserted into the hole 311*e* of the housing 310 from the first connector 311*b*, being supported by the Teflon support members 323*a*. When the Teflon support members 323*a* are fixed at the desired positions, a support member holder 325*a* is fixedly engaged with the end of the main line 330 at the first connector 311*b*. The Teflon support member 323*a* at the first connector 311*b* is fixed, spaced from the end of the first connector 311*b* by a predetermined distance, and the support member holder 325*a* is interposed between the Teflon support member 323*a* and the first connector 311*b*.

The support member holder 325*a* comprises a holder 325*b* inserted fully into the end of the first connector 311*b*, a guide 325*c* extending lengthwise from the holder 325*b*, and a guide hole 325*d* penetrating from one end of the guide 325*c* through the holder 325*b*. The end of the main line 330 extends into the guide hole 325*d* to be connected to another part or an external signal line. A gasket 327 is attached to the surface of the other end of the holder 325*b*, covering the guide 325*c* and extending in a diameter direction of the guide 325*c*. The gasket 327 is added to seal the junction between the part or the external signal line and the first connector 331*b*.

Figure 4:
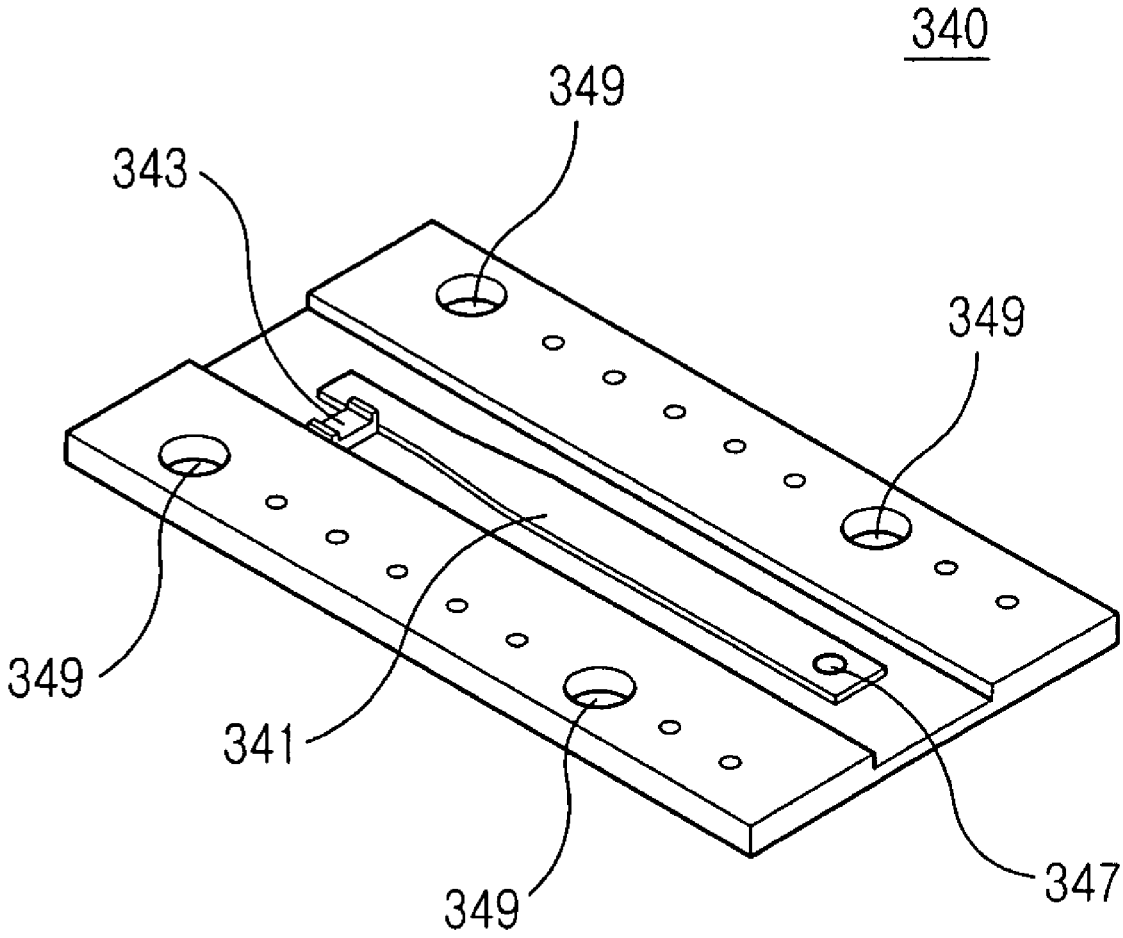
FIG. 4 is a perspective view illustrating a coupling plate included in the connectors-integrated directional coupler illustrated in FIG. 3.
Figure 5:
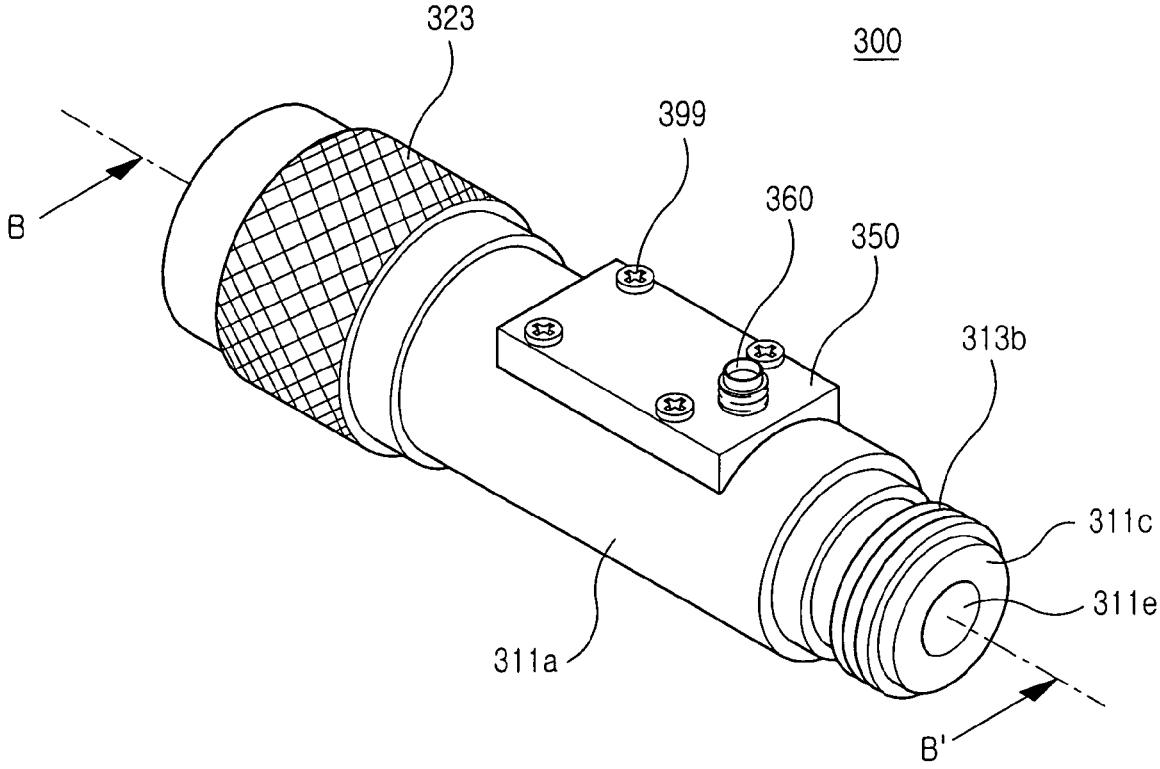
FIG. 5 is a perspective view illustrating an assembled state of the connectors-integrated directional coupler illustrated in FIG. 3.

Referring to FIG. 4, the coupling plate 340 is mounted on the mounting surface 311*d* formed on the outer circumferential surface of the body 311*a* to serve as a sub-line. As shown, a microstrip line 341 of a predetermined shape is formed on the surface of the coupling plate 340. The microstrip line 341 is provided, at an end thereof, with a terminating resistor 434 grounded and, at the other end thereof, with a coupling hole 347 penetrating both surfaces of the coupling plate 340. Screw holes 349 are formed on the coupling plate 340 in correspondence with the coupling holes 315*b* formed on the mounting surface 311*d*. The microstrip line 341 can be shaped depending on desired electrical properties for the directional coupler 300. In the case illustrated in FIG. 4, the microstrip line 341 is narrow at an end connected to the terminating resistor 343 and broad at the other end having the coupling hole 347, thereby ensuring the directivity of the directional coupler 300.

The coupling plate 340 is firmly fixed on the mounting surface 311*d*, while facing, at a bottom surface thereof, the mounting surface 311*d* and being covered, at a top surface thereof, with a planar cover 350. The planar cover 350 has the same shape as that of the coupling plate 340. It is provided with screw holes 359 corresponding to the coupling holes 315*b* of the mounting surface 311*d* and the screw holes 349 of the coupling plate 340. It is further provided with a port hole 351 communicating with the coupling hole 347 of the microstrip line 341.

The planar cover 350 and the coupling plate 340 are screwed on the mounting surface 311*d* by means of screws 399.

A coupling port 360 is inserted into the port hole 351 having screw threads formed on an inner circumferential surface thereof. The coupling port 360 is provided, at an end thereof, with a coupling pin 361 and, on an outer circumferential surface thereof with screw threads 363 corresponding to the screw threads of the port hole 351. In inserting the coupling port 360 into the port hole 351, the coupling pin 361 extends through the coupling hole 347 of the coupling plate 340 and is engaged with the microstrip line 341.

The microstrip line 341 faces the main line 330 through the opening 315*a* of the mounting surface 311*d*. Upon application of a transmitted/received signal or power to the main line, power is also induced to the microstrip line 341. The induced power is output through the coupling port 360 for use in monitoring the signal or power on the main line 330. That is, the microstrip line 341 formed on the coupling plate 340 serves as a coupling line to which power is induced from the main line 330 to monitor a signal delivered along the main line 330. Note that a plurality of coupling plates 340 can be attached, instead of a single one.

In accordance with the present invention as described above, the connectors-integrated directional coupler has input and output connectors integrated with the housing therein, thereby reducing process cost and assembly time and improving productivity. Since there is no discontinuation between the housing and the input/output connector—that is, they are coaxially configured, directivity is improved. Furthermore, the implementation of the microstrip line as a coupling line stably maintains the main line and the coupling line in parallel.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A connectors-integrated directional coupler comprising:

a cylindrical housing having an input connector integrally extended from one end of the housing and an output connector integrally extended from the other end of the housing;

a main line having a main bar and sub bars integrally extending from both ends of the main bar so that the main line connects the input connector to the output connector for delivering a signal;

a coupling plate mounted on an outer circumferential surface of the housing;

an elongated through hole extending from the input connector to the output connector through the housing for accommodating the main line therein;

a coupling line formed on the coupling plate for inducing the signal from the main line thereto; and a planar mounting surface of a predetermined width and length notched in the outer circumferential surface of the housing for mounting the coupling plate thereon and having at least two coupling plates thereon and wherein the housing, the input connector, and the output connector are arranged coaxially.

2. The connectors-integrated directional coupler of claim 1, wherein the coupling line is a microstrip line.

3. The connectors-integrated directional coupler of claim 1, wherein the main line comprises:

a main bar; and sub-bars integrally extending from both ends of the main bar.

4. The connectors-integrated directional coupler of claim 1, wherein the input connector comprises screw threads formed on the outer circumferential surface thereof.

5. The connectors-integrated directional coupler of claim 1, wherein the coupling line comprises a coupling port at one end thereof for outputting power induced from the main line.

6. The connectors-integrated directional coupler of claim 5, further comprising a planar cover having a port hole from which the coupling port protrudes for covering a top surface of the coupling line and closely fixing the coupling line to the housing.

7. The connectors-integrated directional coupler of claim 1, further comprising:

a fixing groove formed to a predetermined depth on the outer circumferential surface of the output connector;

a fixing ring fit around the fixing groove, protruding to a predetermined height from the outer circumferential surface of the first connector; and a hollow cover opened at both ends thereof and engaged with the first connector so that the hollow cover is rotatable around the first connector.

8. The connectors-integrated directional coupler of claim 7, wherein the hollow cover comprises screw threads formed on the inner circumferential surface thereof to allow the hollow cover to be engaged with an external signal line.

9. The connectors-integrated directional coupler of claim 1, further comprising one or more Teflon support members fixed in the elongated hole of the housing, spaced from each other by a predetermined distance.

10. The connectors-integrated directional coupler of claim 9, wherein the Teflon support members provide an electrical isolation between the housing and the main line.

11. The connectors-integrated directional coupler of claim 9, wherein each of the Teflon support members having a through hole formed coaxially with the elongated hole of the housing to allow the main line to extend therethrough.

12. The connectors-integrated directional coupler of claim 9, wherein a plurality of the Teflon support members is formed on the inner wall of the through hole of the housing to determine the positions of the Teflon support members.

13. The connectors-integrated directional coupler of claim 9, further comprising a support member holder, the support member holder including:

a holder fixed to the end of the output connector for preventing the Teflon support member from being out of place from the elongated hole of the housing;

a guide extending from the holder toward the end of the output connector; and a guide hole penetrating the holder and an end of the guide for exposing the main line therefrom.

14. The connectors-integrated directional coupler of claim 9, wherein one of the Teflon support members is spaced from the end of the input connector by a predetermined distance.

15. The connectors-integrated directional coupler of claim 14, further comprising a gasket attached to one end of the holder, covering the outer circumferential surface of the guide and extending in a diameter direction of the guide.

* * * * *